United States Patent [19]

Leral

[11] 3,943,585

[45] Mar. 16, 1976

[54] OUTBOARD ENGINE STORAGE BRACKET

[76] Inventor: Murray M. Leral, 1834 Butler Ave., Los Angeles, Calif. 90025

[22] Filed: June 16, 1975

[21] Appl. No.: 587,079

[52] U.S. Cl. ..... 9/1 R; 9/1 D; 115/17; 248/4; 248/226 A; 285/61

[51] Int. Cl.[2] ..... B63H 21/26

[58] Field of Search ..... 9/1 R, 1 D; 115/17; 248/4, 248/351, 230, 226 D, 226 R, 226 A; 285/61, 62, 156; 403/174, 178, 234, 237; 114/210

[56] References Cited

UNITED STATES PATENTS

| | | | |
|---|---|---|---|
| 3,055,024 | 9/1962 | Schmitt | 9/1 D |
| 3,204,481 | 9/1965 | Golden | 285/156 |
| 3,752,107 | 8/1973 | Tuyl | 114/210 |
| 3,865,334 | 2/1975 | Wait | 248/4 |

*Primary Examiner*—Trygve M. Blix
*Assistant Examiner*—Charles E. Frankfort
*Attorney, Agent, or Firm*—Blakely, Sokoloff, Taylor & Zafman

[57] ABSTRACT

An outboard engine storage bracket for storing a small outboard engine on the railing of a boat. The bracket is comprised of first and second members of wood or plastic which are fastened or clamped together over the rail at the location of a stanchion. When so clamped the two members simulate a transom-like member so that a small outboard engine may be clamped to the bracket for storage in the same manner the engine would ordinarily be clamped to a transom. Suggested fabrication techniques are described.

10 Claims, 5 Drawing Figures

Fig. 1
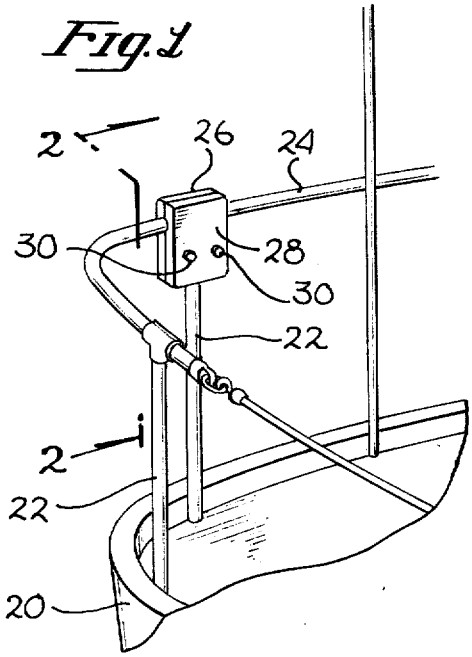
Fig. 3
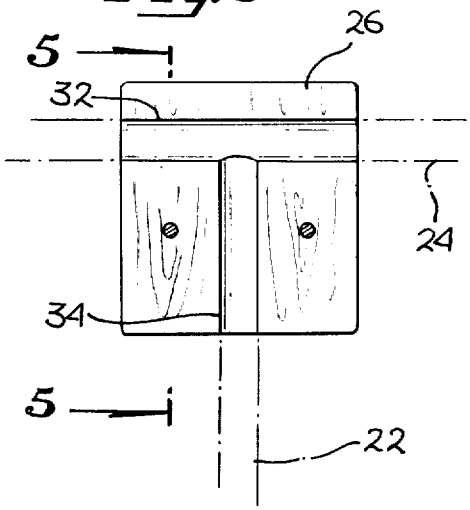
Fig. 4
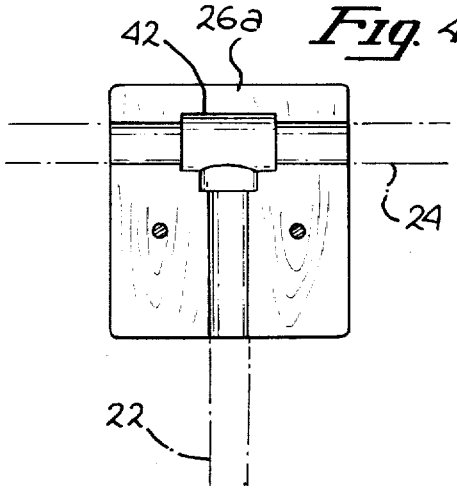
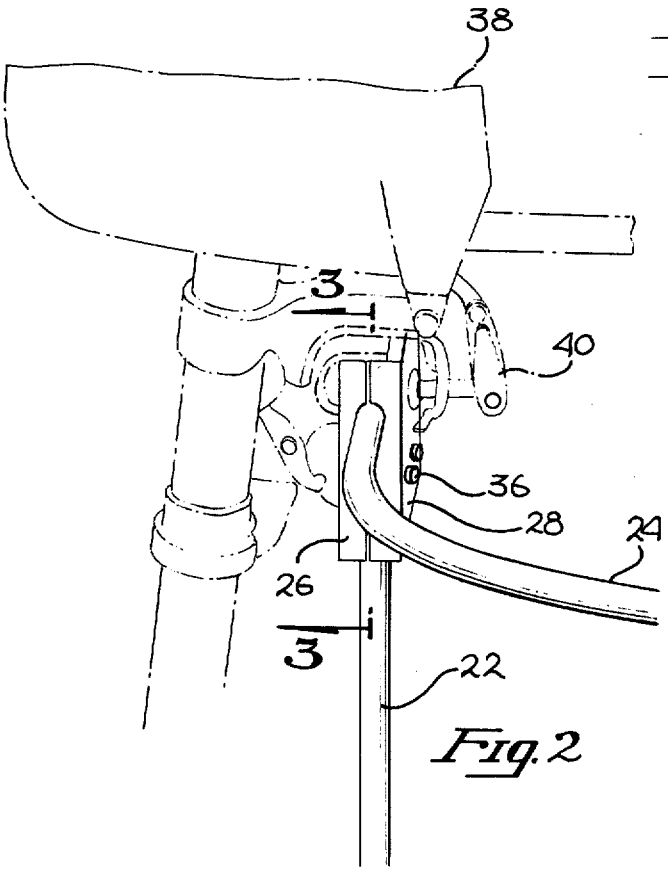
Fig. 2
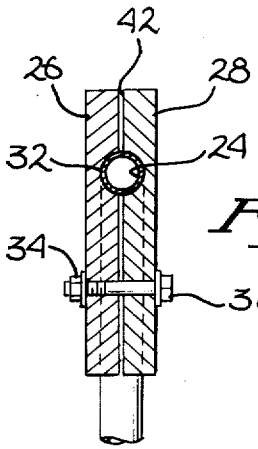
Fig. 5

OUTBOARD ENGINE STORAGE BRACKET

BACKGROUND OF THE INVENTION

1. Field of the Invention

The present invention relates to the field of boat accessories, and more particularly to devices for use in storage of auxilary outboard engines on a boat such as a sailboat.

2. Prior Art

In certain instances small outboard engines may be carried aboard a larger boat for use either as emergency engines for the larger boat, or more typically as auxilary engines for dinghys and inflatable boats which may be used in conjunction with larger boats such as larger sailboats. By way of example, a person might carry a small fiberglass dinghy on a thirty foot sailboat and also somewhere stow a one or two horsepower outboard engine so that the dinghy may conveniently be used as a shore boat when the larger boat is anchored or moored off-shore.

Heretofore, there has not been any form of storage bracket in common use for such purposes. Often the outboard engine will be stowed under the cockpit bench seats, on the floor of the cabin or in the forward vee birth area. None of these locations, however, are really suitable for such purposes and, particularly on sailboats, have a number of disadvantages. One disadvantage with all such locations is that sailboats may heel at very substantial angles and the outboard engine is typically not clamped in position. Accordingly, the engine may roll around, with the possibility of damaging the engine and boat, and creating a safety hazard. These considerations are particularly important when the engine is stored anywhere below decks, as typically the space is very confining and it is very easy to damage the woodwork on the boat by hitting it with the engine. Also, the engine is typically stored in a horizontal position in such locations, and spillage of the gasoline and oil mixture from the fuel tank of the engine is not uncommon.

Thus, an outboard engine which is to be carried aboard a boat such as a sailboat should be clamped or otherwise constrained when stored, should preferably be stored in its vertical or normal disposition, and should be stored external to the finished areas of the boat to minimize the opportunity for damage of either the boat or the motor.

BRIEF SUMMARY OF THE INVENTION

An outboard engine storage bracket for storing a small outboard engine on the railing of a boat. The bracket is comprised of first and second members of wood or plastic which are fastened or clamped together over the rail at the location of a stanchion so that the railing provides vertical support, and the stanchion provides the required rigidity against the rotation of the assembly about the horizontal axis. When the two members are clamped as described, the assembly simulates a transom like member so that a small outboard engine may be clamped to the to the bracket in the conventional manner for storage. Thus, storage fo an engine is provided without holes, brackets or other permanent alterations of the boat being required. The bracket may be fabricated by various techniques, though a specific technique for fabricating the bracket out of wood is suggested. This technique involves the providing of a board of the desired shape and of substantial thickness, of drilling a through hole through the board at the desired location for passage of the rail, drilling a second hole to intercept the first hole at the desired angle in accordance with the angularity between the stanchion and the rail, and finally slicing the board on a plane substantially intermediate to the two larger flat surfaces of the board so as to separate the board into two pieces, and incidentally to remove some material so that the two pieces may be clamped together with the rail and stanchion therebetween in a tight and secure manner.

BRIEF DESCRIPTION OF THE DRAWINGS

FIG. 1 is a perspective view of a portion of the aft rail on a typical sailboat, illustrating the mounting of the present invention;

FIG. 2 is a view of the invention of FIG. 1 taken along the line 2—2 thereof, and further illustrating the manner of clamping a conventional small outboard to the device of the present invention;

FIG. 3 is a partial cross-section taken along line 3—3 of FIG. 2;

FIG. 4 is a partial cross-section similar to FIG. 3 illustrating an alternate embodiment of the present invention;

FIG. 5 is a partial cross-section taken along line 5—5 of FIG. 3.

DETAILED DESCRIPTION OF THE INVENTION

First referring to FIG. 1, the aft portion of the railing on a typical sailboat 20 may be seen. Such rails normally are supported on stanchions 22, and enclose the rear portion of the cockpit with a solid U-shaped bar or railing 24. Typically the stanchions 22 and rail 24 are tubular members, such as stainless steel or chrome plated steel tubular members joined into an integral assembly by some conventional fabrication technique such as welding prior to final finishing of the members. While the stanchions and rail may be of different diameters, and special T-fittings may be used at each junction of the rail and a stanchion, more commonly the rail and stanchions are of the same diameter tubing and comprise a welded assembly (e.g. without special fittings between the stanchions and rail). More specifically, typically the aft section of the rail, such as is commonly found on sail boats, is a single smoothly curved tubular member with the individual stanchions being welded thereto at the appropriate locations, and carefully finished so as to fairly well approximate the theoretical intersection of two cylinders. Further, while all stanchions do not necessarily intersect a rail at right angles, it is common to find at least two stanchions in the aft section of the rail, and probably more than two stanchions in the forward sections of rail which do intersect the rail at right angles. The present invention as it might mount to the rail at the location of one of the stern stanchions is shown in FIG. 1. The invention is comprised in its simplest form of first and second members 26 and 28 fastened or clamped together in face-to-face disposition by some suitable fastening or clamping means 30. When so clamped the two members 26 and 28 simulate a small transom like member to which a small outboard motor may be fastened or clamped in the conventional manner.

Details of the structure of members 26 and 28 may be seen in FIGS. 3 and 5. In particular, in the preferred embodiment members 26 and 28 are identical members, each being symmetrical about a center vertical plane perpendicular to the axis of the rail. FIG. 3 is a partial cross-section taken through the axis of the rail 24 and a stanchion 22, and illustrates the T-shaped slot in the inner face of each member 26 and 28 formed by the horizontal depression 32 and intersecting depression 34. As can be seen in FIG. 5, which is a partial cross-section taken along line 5—5 of FIG. 3, the depressions are preferably bounded by circular arc segments so as to fit snuggly and securely against the rail section 24 of similar diameter. In this embodiment the two members 26 and 28 are clamped or fastened together by conventional nuts and bolts 34 and 36, preferably of a highly corrosion resistant material such as brass or stainless steel. In the embodiment shown the nuts and bolts 34 and 36 are not countersunk, but instead are so positioned so as to not interfere with the normal mounting of a small outboard engine, such as engine 38 as shown in FIG. 2. The choice of such a suitable location is not difficult, particularly with respect to the member which will be abutted by clamp 40, as normally such clamps contact a transom higher than the portion of the engine bracket abutting the opposite face of the stanchion. If desired, of course, either or both sides of the fastener may be countersunk so that no portion of the fastener protrudes above the surface of either member so as to thereby be independent of any unusual or different location of a clamp, or other unusual characteristics of the engine mounting.

Also, as may be seen in FIG. 2, it will be noted that the horizontal depressions 32 are reasonably near the top of members 26 and 28, and accordingly, the normal location of the clamps 40 on the engine is such as to themselves encourage the tight clamping of members 26 and 28 to the rail 24. Accordingly, the clamps or fasteners 30 as shown in FIG. 1, or more particularly in the embodiment specifically shown, the nuts and bolts 34 and 36 need only be sufficient to securely hold the members in position while an engine is being mounted or removed.

Preferably the present invention is fabricated from a single piece of wood of sufficient thickness to satisfactorily simulate a transom. The board is first cut to the desired dimensions consistent with the maximum size of the engine to be mounted thereto which, in turn, is somewhat dependent upon the size and strength of the railing to which it will be mounted. Thereafter a first horizontal through hole of the size of the railing 24 and at a location of a desired depression to mate with the railing is drilled through the board, with the axis of the hole falling approximately at the center of the thickness of the board. Thereafter a second hole is drilled to intersect the first through hole at the desired angle (typically ninety degrees, though if desired at some other angle in accordance with the stanchion to rail angularity of the particular boat on which the device is to be used). Finally, a saw cut is made in the plane of the axis of the two holes so as to separate the board into the two pieces 26 and 28. Of course, this same saw cut removes a certain amount of material so that when members 26 and 28 clamp together to securely grasp a rail and stanchion, there will still be some slight separation 42 between the facingly disposed surfaces of the two members.

The preferred embodiment and the method of fabrication thereof has been described in detail. The fabrication of the invention from wood such as by way of example, mahogany or a harder wood such as teak results in a reasonably low cost device which is attractive in appearance and durable in service. Accordingly, the device may be permanently mounted on the boat, and for this purpose fastening means such as brass or stainless steel wood screws are suitable, and as a matter of convenience the nuts 34 shown in FIG. 5 may be conventional wing nuts for mounting and removal without tools. Also while not previously mentioned, it should be noted that if the present invention is to be fabricated of wood, it is preferable to orient the wood so that the grain of the wood runs in the vertical direction, as mounted, as this orientation provides maximum durability and resistance to splitting due to the load of the engine imposed thereon.

As an alternate, depending upon the specific construction of the rail, members 26 and 28 may have a further relieved area in the region in the junction of the two depressions to accommodate any bulge or protrusion on that region. Thus as shown in FIG. 4, member 26*a* may be provided with relieved region 42 for this purpose.

Obviously many other variations may be made in the present invention. By way of specific example, members 26 and 28 may be identical injection molded members in which case the inner surface of each member would preferably be relieved and webbed for adequate strength with minimum material. Further, the depressions 32 and 34 in members 26 and 28 may also be V-shaped depressions rather than rounded depressions, so that the members will securely mount to rails of varying diameters. Also, members 26 and 28 do not necessarily have to be identical, but one member may be thicker than the other and have a suitably disposed U-shaped slot therein slightly less than the diameter of the rail and stanchion, with a second thinner flat member being clamped thereto to secure the assembly to the rail. Thus, while the invention has been disclosed and described with respect to certain preferred embodiments thereof, it will be understood by those skilled in the art that various changes in form and detail may be made therein without departing from the spirit and scope of the invention.

I claim:

1. A device for storing an outboard engine on a boat comprising first and second generally flat members, each having first and second surfaces, and means for clamping said first and second members together, at least one of said first and second members having a depression on said first surface thereof to mate with a railing on a boat, said means for clamping said first and second members together being a means for clamping said first and second members together with said first surfaces into a face-to-face disposition with a railing therebetween, whereby said first and second members may be supported by the railing to provide a transom-like assembly for support of an outboard engine.

2. The device of claim 1 wherein said first and second members each have a depression on said first surfaces thereof to mate with a railing on a boat.

3. The device of claim 1 wherein the one of said first and second members having a depression on said first surface thereof to mate with a railing on a boat further has a depression on said first surface to mate with a stanchion supporting the railing, whereby said means for clamping is a means for clamping said first and second members together with first surfaces into face-to-face disposition with a railing and a stanchion therebetween.

4. The device of claim 3 wherein said first and second members each have a depression on said first surface thereof to mate with a railing and a stanchion on a boat.

5. The device of claim 1 wherein said first and second members are wood members.

6. The device of claim 5 wherein the grain of the wood is oriented in a direction generally perpendicular to said depression for mating with a railing of a boat.

7. A device for use in storing an outboard engine on a boat having a section of railing supported by spaced apart stanchions; comprising:

a. first and second generally flat members, each of said members having a T-shaped depression in a first surface thereof, whereby said first and second members may be clamped together with the surfaces having said T-shaped depression in face-to-face disposition over a section of railing at a stanchion to simulate a small transom, and b. means for clamping said first and second members together.

8. The device of claim 7 wherein said T-shaped depressions are each sections of a circular arc of less than 180°.

9. The device of claim 8 wherein said first and second members are wood members.

10. The device of claim 9 wherein the grain of the wood is oriented in a direction generally perpendicular to said depression for mating with a railing of a boat.

* * * * *